US006722443B1

(12) United States Patent
Metcalfe

(10) Patent No.: US 6,722,443 B1
(45) Date of Patent: Apr. 20, 2004

(54) CONNECTOR FOR EXPANDABLE WELL SCREEN

(75) Inventor: Paul David Metcalfe, Scotland (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/762,410

(22) PCT Filed: Aug. 9, 1999

(86) PCT No.: PCT/GB99/02605

§ 371 (c)(1),
(2), (4) Date: May 17, 2001

(87) PCT Pub. No.: WO00/08301

PCT Pub. Date: Feb. 17, 2000

(30) Foreign Application Priority Data

Aug. 8, 1998 (GB) ..... 9817246

(51) Int. Cl.[7] ..... E21B 43/10; E21B 19/16; E21B 29/10

(52) U.S. Cl. ..... 166/384; 166/207; 166/236; 403/277; 285/53; 285/65

(58) Field of Search ..... 166/277, 384, 166/380, 206, 207, 216, 217, 227, 238, 235, 242.2, 242.6, 242.3; 403/277, 278; 285/45, 47, 48, 53, 65, 106, 107, 109, 355, 417

(56) References Cited

U.S. PATENT DOCUMENTS

| | | | | |
|---|---|---|---|---|
| 1,678,640 A | * | 7/1928 | Hall | 285/382.2 |
| 2,226,804 A | * | 12/1940 | Carroll | 166/227 |
| 2,873,985 A | * | 2/1959 | Baldwin, Jr. | 285/342 |
| 3,766,991 A | | 10/1973 | Brown | 173/20 |
| 3,857,450 A | | 12/1974 | Guier | 175/85 |
| 3,913,687 A | | 10/1975 | Gyongyosi et al. | 175/85 |

(List continued on next page.)

FOREIGN PATENT DOCUMENTS

| | | | |
|---|---|---|---|
| EP | 0 171 144 A1 | 2/1986 | E21B/19/06 |
| EP | 0 659 975 | 6/1995 | E21B/43/08 |
| WO | WO 9312323 A1 * | 6/1993 | E03B/3/18 |
| WO | 97/17524 | 5/1997 | E21B/43/08 |
| WO | 98/22690 | 5/1998 | E21B/17/08 |
| WO | 98/32948 | 7/1998 | E21B/19/16 |

OTHER PUBLICATIONS

"polytetrafluoroethylene" Encyclopædia Brittannica <http://www.search.eb.com/eb/article?eu=62273> [Accessed Oct. 22, 2002].*

"industrial polymers, major" Encyclopædia Britannica <http://www.search.eb.com/eb/article?eu=129054> [Accessed Oct. 22, 2002].*

*Primary Examiner*—David Bagnell
*Assistant Examiner*—Jennifer H. Gay
(74) *Attorney, Agent, or Firm*—Moser, Patterson & Sheridan, L.L.P.

(57) ABSTRACT

A tubing connection arrangement (10) comprises two expandable tubing sections (12, 14), each tubing section comprising a filter screen (16, 18) sandwiched between inner expandable tubing (20, 22) and outer expandable tubing (24, 26). The filter screen of one tubing section overlaps the filter screen of the other tubing section and the outer expandable tubing of at least one of the tubing sections extends over the overlapping filter screens. On expansion of the tubing sections, the overlapping filter screens, restrained by the outer tubing, ensure the integrity of the filter between the tubing sections.

31 Claims, 1 Drawing Sheet

Figure 1:
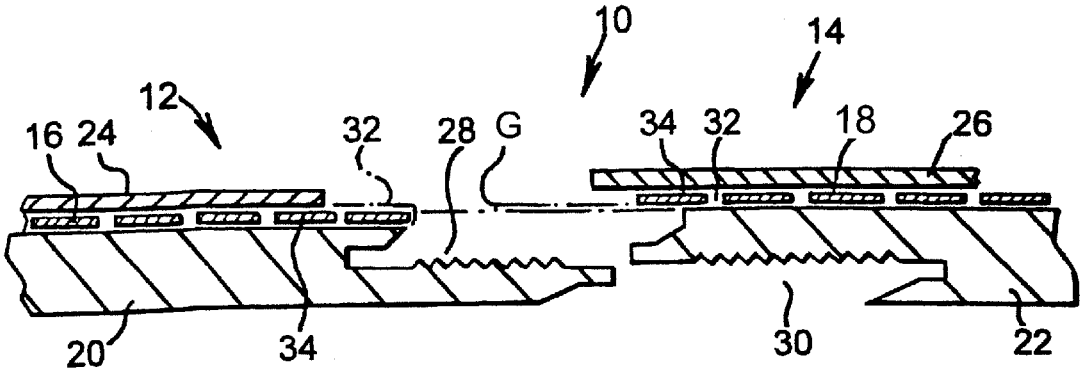

U.S. PATENT DOCUMENTS 4,076,280 A * 2/1978 Young ..... 285/39
4,449,596 A 5/1984 Boyadjieff ..... 175/85
4,625,796 A 12/1986 Boyadjieff ..... 166/77.5
4,754,807 A 7/1988 Lange ..... 166/236
4,771,829 A * 9/1988 Sparlin ..... 166/233
4,793,422 A 12/1988 Krasnov ..... 175/57
4,813,493 A 3/1989 Shaw et al. ..... 173/164
4,878,546 A 11/1989 Shaw et al. ..... 173/163
4,985,975 A * 1/1991 Austin et al. ..... 29/283.5
5,181,570 A * 1/1993 Allwin et al. ..... 166/381
5,251,709 A 10/1993 Richardson ..... 175/220
5,339,895 A * 8/1994 Arterbury et al. ..... 166/227
5,388,651 A 2/1995 Berry ..... 175/85
5,787,980 A * 8/1998 Sparlin et al. ..... 166/231
5,855,242 A * 1/1999 Johnson ..... 166/236
5,901,789 A * 5/1999 Donnelly et al. ..... 166/207
5,924,745 A * 7/1999 Campbell ..... 138/109
5,984,568 A * 11/1999 Lohbeck ..... 166/207
6,012,522 A * 1/2000 Donnelly et al. ..... 166/207
6,109,349 A * 8/2000 Simone et al. ..... 166/230
6,158,507 A * 12/2000 Rouse et al. ..... 166/228
6,273,634 B1 * 8/2001 Lohbeck ..... 166/207
6,315,040 B1 * 11/2001 Donnelly ..... 166/207
6,322,109 B1 * 11/2001 Campbell et al. ..... 138/118
6,409,175 B1 * 6/2002 Evans et al. ..... 277/314
2002/0070031 A1 * 6/2002 Voll et al. ..... 166/380

* cited by examiner

CONNECTOR FOR EXPANDABLE WELL SCREEN

This invention relates to a downhole connector, and in particular to an arrangement for ensuring the integrity of a sand screen or other filter medium at a connection between two lengths of expandable tubing utilised to support or form a sand screen or filter.

In many well bores where a liquid, for example oil, passes from a surrounding formation into the well bore, the liquid will often carry entrained sand particles. If this sand is permitted to pass into the well bore a number of problems may arise, including an increased likelihood of the well bore becoming blocked or restricted, and the sand may cause downhole tools to stick or jam, or wear prematurely. Accordingly, it is preferred that the sand particles are retained in the formation. This is achieved by providing screens or a filter around the casing or production tubing.

International Patent Application WO 97/17524 (Shell), the disclosure of which is incorporated herein by reference, describes a radially expandable assembly in which overlapping filter sheets are sandwiched between inner expandable support tubing and outer expandable protective tubing, the expandable tubing featuring large numbers of overlapping longitudinal slots. When an expander cone is forced through the assembly, the inner and outer tubing is expanded radially, the slots extending to form diamond-shaped openings. The initial degree of overlap between the screens is selected such that, although the screens move circumferentially relative to one another during expansion, the edges of the screens remain in overlapping relation. Such an arrangement can easily be constructed over sections of plain tubing or pipe. However, at the connections between tubing sections, where the inner tubing sections are coupled together, it is difficult to maintain a "sand-tight" join.

It is among the objectives of embodiments of the present invention to provide a connector arrangement which obviates or mitigates this difficulty.

According to the present invention there is provided a connector arrangement for provision between the ends of two sections of expandable tubing, each expandable tubing section comprising a filter screen sandwiched between inner expandable tubing and outer expandable tubing, the filter screen of one tubing section overlapping the filter screen of the other tubing section and the outer expandable tubing of at least one of the tubing sections extending over the overlapping filter screens.

The invention also relates to expandable tubing sections which are adapted to be connected in this manner, and to expandable tubing strings incorporating such connector arrangements, and to a method of connecting tubing sections.

On expansion of the tubing sections, the overlapping filter screens, restrained by the outer tubing, ensure the integrity of the filter between the tubing sections.

The outer expandable tubing of one tubing section may be arranged to overlap or to bust against the outer expandable tubing of the other tubing section.

Each filter screen will typically comprise a plurality of overlapping plates, sheets or membranes individually mounted to the respective inner expandable tubing by axially parallel connectors or fixings, such as screws, lugs or welds.

Preferably, the filter screens of each tubing section are initially radially spaced apart to facilitate make-up of the connector. However, on expansion, the resistance of the outer tubing to radial expansion of the inner tubing ensures that the outer filter screen is pressed into sand-tight engagement with the inner filter screen. The desired relative positioning of the filter screens of the two tubing sections may be achieved by providing one inner tubing section having an end of slightly larger diameter than the other. In certain embodiments the ends of each tubing section may be upset, that is of greater diameter than the remainder of the tubing section, and the desired difference in diameter may be achieved by providing a slightly higher upset on one tubing section. Conveniently, the inner tubing sections will feature pin and box connections, and the upset on the box may be slightly higher than the pin. Of course the opposite arrangement may provided, that is the pin upset being higher than the box.

The ends of one or both filter screens may be provided with means for preventing interference between the screen ends when the tubing sections are rotated relative to one another, as may be the case if the tubing sections are threaded to one another. Said means may take the form of a sleeve of flexible or extendible material located internally and\or externally of the filter screens. The sleeve may be formed of flexible slotted tubing, plastics, rubber, wire mesh or wire composites.

According to another aspect of the present invention there is provided a section of expandable tubing comprising a filter medium sandwiched between inner expandable tubing and outer expandable tubing, the filter medium comprising a plurality of circumferentially extending filter sheets, each sheet being coupled at one edge to one of the inner and outer tubing and having the opposite edge overlapping an adjacent sheet, and means for reducing the friction between at least one of the filter sheets and the filter sheets and the tubing.

In other aspects of the invention friction reducing means may be provided on other parts or elements of a tubing section.

This aspect of the invention may be provided in combination with the first described aspect.

In use, the friction reducing means facilitates expansion of the tubing by facilitating relative circumferential movement of the filter sheets relative to one another and of the filter sheets relative to the tubing. The presence of such friction reducing means also reduces the likelihood of damage occurring to the relatively fragile filter sheets during expansion, as has been found to occur on occasion in tubing made in accordance with WO 97/17524.

Preferably, the friction reducing means is a low friction coating applied to the filter sheets, such as a PTFE-based material such as Teflon (trade mark). In other embodiments a friction-reducing lubricant, such as high temperature grease, may be provided. Alternatively, sheets of low friction material may be placed between the filter sheets and the tubing.

Figure 2:
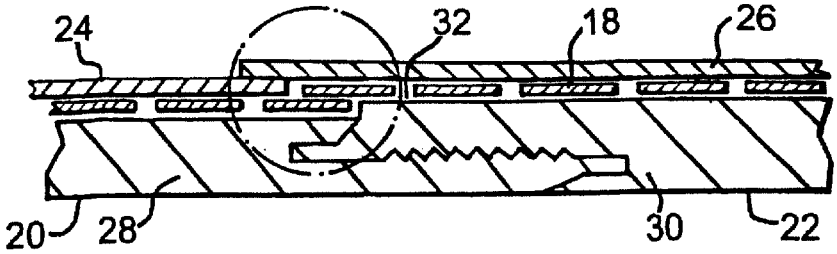

These and other aspects of the present invention will now be described, by way or example, with reference to the accompanying drawings, in which:

FIG. 1 is a schematic sectional view of part of a connector in accordance with a preferred embodiment of the present invention, with the connector parts shown separated; and FIG. 2 is a schematic sectional view of the connector of FIG. 1, with the connector parts shown coupled together.

The drawings illustrate part of a connector 10 in accordance with an embodiment of the present invention. The connector 10 is provided between the ends of two sections of expandable tubing 12, 14, each comprising filter plates 16, 18 sandwiched between inner expandable support tubing

20, 22 and outer expandable protective tubing 24, 26. Each section of expandable tubing 20, 22, 24, 26 defines a large number of longitudinal overlapping slots. The sections of inner or base expandable tubing 20, 22 are formed with co-operating pin and box connections 28, 30, to allow the tubing sections 12, 14 to be made up by relative rotation.

As is more clearly apparent from FIG. 2, the box connection 30 is upset from the pin 28. The filter plates 18 mounted around the box 30 extend beyond the end of the box outer surface 32 such that on making up the connection the filter plates 18 overlap the filter plates 16 mounted on the pin 28. The outer tubing 24 on the pin 28 terminates short of the end of the filter plates 16 to accommodate the filter plate overlap, and the outer tubing 24 is similarly overlapped by the end of the outer tubing 26 on the box 30.

The overlapping filter plates 16, 18 are positioned such that there is a small radial gap G between the filter plates 16, 18, to allow the connection to be made up without snagging or galling of the opposing filter plates.

When the connection is expanded downhole, by passing a cone through the connection, the outer tubing 24, 26 resists the expansion of the inner tubing 20, 22. This results in the outer tubing 24, 26 providing an inward radial force which maintains the overlapping filter plates 16, 18 in engagement and effects a sand-tight seal.

To facilitate make-up and backing-off of the connection 10, the ends of the filter plates 16 are provided with an expandable make-up protection sleeve 32 which prevents the overlapping plates on either the pin 28 or the box 30 from snagging on the opposing filter plates when the pin and box are rotated relative to one another.

To facilitate expansion of the tubing, the filter plates 16, 18 are provided with a coating 34 of a low-friction material, in this case a PTFE-based material such as Teflon. This coating facilitates relative movement of the plates 16, 18, and relative movement of the plates 16, 18 and the tubing 20, 22, 24, 26, and minimises the risk of tearing of the filter plates 16, 18 as the tubing sections are made up and expanded.

It will be clear to those of skill in the art that the above-described embodiment is merely exemplary of the present invention, and that various modifications and improvements may be made thereto without departing from the scope of the present invention.

What is claimed is:

1. A tubing connection arrangement comprising two expandable tubing sections, wherein each tubing section comprises a filter screen sandwiched between an inner expandable tubing and an outer expandable tubing, wherein the filter screen of one tubing section overlaps the filter screen of the other tubing section, and wherein the outer expandable tubing of at least one of the tubing sections extends over the overlapping filter screens.

2. The arrangement of claim 1, wherein the outer expandable tubing of one tubing section is arranged to overlap the outer expandable tubing of the other tubing section.

3. The arrangement of claim 1, wherein the outer expandable tubing of one tubing section is arranged to butt against the outer expandable tubing of the other tubing section.

4. The arrangement of claim 1, wherein each filter screen comprises a plurality of overlapping sheets individually mounted to the respective inner expandable tubing by axially parallel fixings.

5. The arrangement of claim 1, wherein the filter screen of one tubing section is initially of greater diameter than the filter screen of the other tubing section such that the filter screens are initially radially spaced apart.

6. The arrangement of claim 5, wherein the inner tubing of said one tubing section has an end of larger diameter than the end of the inner tubing of the other tubing section.

7. The arrangement of claim 6, wherein the ends of at least one tubing section are upset.

8. The arrangement of claim 7, wherein the ends of both tubing sections are upset, with a higher upset being provided on one tubing section.

9. The arrangement of claim 7, wherein the inner tubings incorporate pin and box connections, and the upset on the box is higher than the upset on the pin.

10. The arrangement of claim 1, wherein the end of at least one filter screen is provided with means for preventing interference between the screen ends when the tubing sections are rotated relative to one another.

11. The arrangement of claim 10, wherein said means for preventing interference is a sleeve of extendible material.

12. The arrangement of claim 11, wherein the sleeve extends internally of at least one of the filter screens.

13. The arrangement of claim 11, wherein the sleeve extends externally of at least one of the filter screens.

14. The arrangement of claim 1, wherein the filter screen comprises a plurality of circumferentially extending filter sheets, each sheet being coupled at one edge to one of the inner and outer tubing, having the opposite edge overlapping an adjacent sheet, and being coated with a low friction coating configured for reducing the friction between at least one of the filter sheets and the tubing.

15. The connection of claim 1, wherein the expansion resistance member comprises a sleeve.

16. The connection of claim 15, wherein the sleeve substantially surrounds the connection.

17. A tubing connection method comprising:

providing at least two expandable tubing sections, each tubing section comprising a filter screen sandwiched between an inner expandable tubing and an outer expandable tubing; and connecting the tubing sections such that the filter screen of one tubing section overlaps the filter screen of the other tubing section and the outer expandable tubing of at least one of the tubing sections extends over the overlapping filter screens.

18. A section of expandable tubing comprising: two filter screens sandwiched between an inner expandable tubing and an outer expandable tubing, each filter screen comprising a plurality of circumferentially extending filter sheets, each sheet being coupled to the inner expandable tubing and coated with a low friction coating configured to reduce the friction between the filter sheets.

19. The section of claim 18, wherein the low friction coating is made from a polytetrafluoroethylene-based material.

20. The section of claim 18, wherein the low friction coating is further configured to reduce the friction between at least one of the filter sheets and the outer expandable tubing.

21. An expandable connector for connecting portions of expandable tubing comprising:

a first connector portion and a second connector portion, the first and second portions being threadably engaged to one another;

an outer tubular member for surrounding a portion of the threadably engaged first and second portions and resisting a radial expansion thereof; and a filter screen having a plurality of circumferentially extending filter sheets, wherein each sheet is coupled to one of the first connector portion and second connector portion at one edge and overlaps an adjacent sheet at the opposite edge.

22. An expandable connection for well bore tubulars, comprising:

a first well bore tubular having a first connection member:

a second well bore tubular having a second connection member;

wherein the first connection member is threadably engaged with the second connection member to form the expandable connection;

an expansion resistance member disposed outside the expandable connection for resisting the expansion of the expandable connection; and a filter screen having a plurality of circumferentially extending filter sheets, wherein each sheet is coupled to one of the first connection member and the second connection member at one edge and overlaps and adjacent sheet at the opposite edge.

23. A method of expanding a wellbore tubular, comprising:

providing a wellbore tubular having a first connection member threadably engaged with a second connection member and an expansion resistance member disposed therearound; and expanding the first and second connection members radially outward against an inward radial force provided by the expansion resistance member, the first and second connection members remaining threadably engaged during and after expansion.

24. An expandable connector for connecting portions of expandable tubing, comprising:

a first connector portion and a second connector portion, the first and second portions being inter-engageable and expandable to produce a larger diameter connection between the portions that remains inter-engageable; and an outer tubular member for surrounding a portion of the inter-engaged first and second portions and for resisting the radial expansion thereof.

25. The connector of claim 24, wherein the outer tubular member is expandable.

26. The connector of claim 24, wherein the first connector portion and the second connector portion are engaged by a threaded connection.

27. A method of expanding a tubular connection, comprising:

providing a first connection portion engaged with a second connection portion;

providing an outer member partially surrounding the engaged portions; and expanding the engaged portions radially outward, thereby causing the outer member to expand while resisting a radial expansion force exerted by the engaged portions whereby the first connection portion and the second connection portion remain engaged after expansion.

28. The method of claim 27, wherein the first and second portions are engaged by a threaded connection.

29. The method of claim 27, wherein the outer member expands as a result of the engaged portions being expanded radially outward.

30. An expandable connection for expandable tubulars, comprising:

a first expandable tubular having a first connection member;

a second expandable tubular having a second connection member engaged with the first connection member, wherein the first and second connection members are expandable, and the first and second connector members remain engaged following expansion thereof; and an outer tubular member surrounding a portion of the engaged first and second connection members, wherein the outer tubular member is configured to expand in response to the first and second connection members being expanded.

31. A method of expanding a tubular connection comprising:

providing a first connection portion engaged with a second connection portion, the portions being expandable; and expanding the portions radially outward while applying a force from without the tubular connection, wherein the force opposes the expansion and causes the engagement to retain integrity following the expansion.

* * * * *